US008439344B2

(12) United States Patent
Asada et al.

(10) Patent No.: US 8,439,344 B2
(45) Date of Patent: May 14, 2013

(54) IMAGE RECORDING DEVICE

(75) Inventors: Tetsuo Asada, Kuwana (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/242,395

(22) Filed: Sep. 23, 2011

(65) Prior Publication Data

US 2012/0080833 A1 Apr. 5, 2012

(30) Foreign Application Priority Data

Sep. 30, 2010 (JP) ..... 2010-223116

(51) Int. Cl.
*B65H 3/44* (2006.01)
*B65H 5/26* (2006.01)

(52) U.S. Cl.
USPC ..... 271/9.11; 271/9.07; 271/9.08; 271/9.13; 271/9.09; 271/3.14

(58) Field of Classification Search ..... 271/9.07, 271/9.08, 9.11, 9.13, 9.09
See application file for complete search history.

(56) References Cited

U.S. PATENT DOCUMENTS

| | | | | |
|---|---|---|---|---|
| 3,989,236 | A | 11/1976 | Komori et al. | |
| 4,131,274 | A | 12/1978 | Sue | |
| 4,928,129 | A | 5/1990 | Honda | |
| 7,403,739 | B2 * | 7/2008 | Hwang | 399/391 |
| 7,547,011 | B2 * | 6/2009 | Kurata et al. | 271/9.11 |
| 7,584,950 | B2 * | 9/2009 | Asada et al. | 271/9.07 |
| 7,600,745 | B2 * | 10/2009 | Asada | 271/9.08 |
| 7,628,392 | B2 * | 12/2009 | Shiohara et al. | 271/9.08 |
| 7,654,515 | B2 * | 2/2010 | Koga | 271/9.08 |
| 7,677,548 | B2 * | 3/2010 | Chino | 271/9.11 |
| 7,681,875 | B2 * | 3/2010 | Asada et al. | 271/9.08 |
| 7,690,640 | B2 * | 4/2010 | Koga et al. | 271/9.13 |
| 7,748,692 | B2 * | 7/2010 | Shiohara | 271/9.11 |

(Continued)

FOREIGN PATENT DOCUMENTS

| | | | |
|---|---|---|---|
| JP | H06-008138 | Y2 | 3/1994 |
| JP | 2007-230777 | A | 9/2007 |
| JP | 2010-037095 | A | 2/2010 |

OTHER PUBLICATIONS

United States Patent and Trademark Office, Office Action for U.S. Appl. No. 12/894,030 (counterpart to above-captioned patent application), mailed Feb. 16, 2012.

(Continued)

*Primary Examiner* — Kaitlin Joerger
(74) *Attorney, Agent, or Firm* — Baker Botts L.L.P.

(57) ABSTRACT

An image recording device includes a housing, a tray unit mounted in the housing and configured to hold thereon sheets, a feeder configured to feed a sheet from the tray unit, a recording unit configured to record an image on the sheet fed by the feeder, and a discharging unit configured to discharge the sheet after the recording unit records the image on the sheet. The tray unit includes a first tray including a first holding surface for holding thereon a first sheet, a second tray includes a second holding surface for holding thereon a second sheet and configured to move above the first holding surface between a first position and a second position, and a third tray supported by the first tray and disposed above the second tray in the second position, and configured to receive the sheet discharged by the discharging unit.

19 Claims, 12 Drawing Sheets

U.S. PATENT DOCUMENTS

| | | | | |
|---|---|---|---|---|
| 7,878,500 | B2 * | 2/2011 | Wakakusa | 271/162 |
| 2007/0075476 | A1 | 4/2007 | Shiohara | |
| 2007/0182803 | A1 | 8/2007 | Asada et al. | |
| 2009/0001652 | A1 | 1/2009 | Asada | |
| 2010/0164169 | A1 * | 7/2010 | Wakakusa | 271/127 |
| 2011/0241288 | A1 | 10/2011 | Asada et al. | |
| 2012/0081488 | A1 | 4/2012 | Asada et al. | |
| 2012/0081489 | A1 | 4/2012 | Asada et al. | |

OTHER PUBLICATIONS

United States Patent and Trademark Office, Office Action for U.S. Appl. No. 12/894,030 (co-pending U.S. patent application), mailed Aug. 1, 2012.

* cited by examiner

IMAGE RECORDING DEVICE

CROSS REFERENCE TO RELATED APPLICATION

The present application claims priority from Japanese Patent Application Publication No. JP-2010-223116, which was filed on Sep. 30, 2010, the disclosure of which is incorporated herein by reference in its entirety.

BACKGROUND OF THE INVENTION

1. Field of the Invention

The present invention relates to an image recording device comprising a tray unit that comprises a plurality of trays configured to hold recording media subjected to image recording and the recording media having images recorded thereon.

2. Description of Related Art

A known image recording device comprises a tray unit comprising a main tray and a second tray each configured to hold thereon recording media. For example, A4 size recording sheets are placed on the main tray, and postcards are placed on the second tray. The second tray is disposed on the main tray and is configured to move between a position allowing a feeder to contact the second tray and a position separated from the feeder. The feeder selectively feeds a sheet from the main tray and the second tray to a recording unit, depending on the position of the second tray. The second tray comprises a discharged sheet receiver configured to receive the sheet discharged by a discharge unit after the recording unit records an image on the sheet.

SUMMARY OF THE INVENTION

It is beneficial to enhance the usability of a plurality of trays in an image recording device.

According to an embodiment of the invention, an image recording device comprises a housing, a tray unit mounted in the housing and configured to hold thereon a first sheet and a second sheet, a feeder disposed above the tray unit and configured to selectively feed the first sheet and the second sheet from the tray unit in a first direction, a recording unit disposed above the feeder and configured to record an image on the sheet fed by the feeder, and a discharging unit configured to discharge the sheet after the recording unit records the image on the sheet. The tray unit comprises a first tray comprising a first holding surface for holding thereon the first sheet, a second tray comprising a second holding surface for holding thereon the second sheet and configured to move above the first holding surface between a first position and a second position which is upstream in the first direction from the first position, and a third tray supported by the first tray and disposed above the second tray in the second position, and configured to receive the sheet discharged by the discharging unit.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

FIG. 10A shows the tray unit when a second tray is in a second position, and FIG. 10B shows the tray unit when the second tray is in a first position.

FIG. 11A shows the tray unit when a second tray is in a second position, and FIG. 11B shows the tray unit when the second tray is in a first position.

FIG. 12A shows the tray unit when a second tray is in a second position, and FIG. 12B shows the tray unit when the second tray is in a first position.

DETAILED DESCRIPTION OF EMBODIMENTS

Embodiments of the invention and their features and technical advantages may be understood by referring to FIGS. 1-12B, like numerals being used for like corresponding parts in the various drawings.

Figure 1:
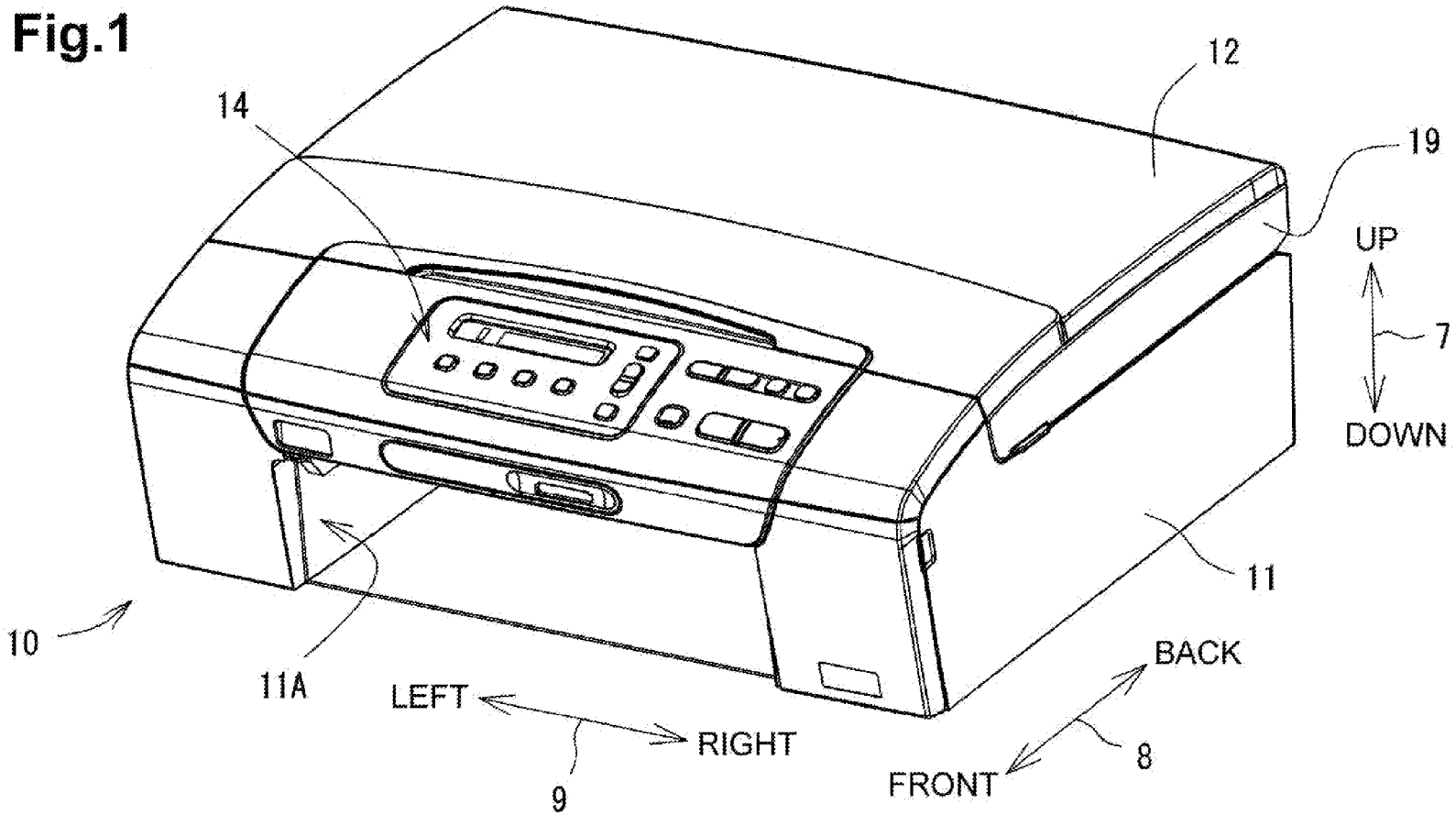
FIG. 1 is a perspective view of an image recording device according to an embodiment of the invention.

An image recording device according to an embodiment of the invention is, for example, a multifunction device 10 having a scanning function, a printing function, a coping function, and a facsimile function, as shown in FIG. 1. In the following description, the height direction of the multifunction device 10, which has a rectangular parallelepiped external shape, is defined as an up-down direction 7, the depth direction thereof is defined as a front-back direction 8, and the width direction thereof is defined as a left-right direction 9.

As shown in FIG. 1, the multifunction device 10 comprises a printer housing 11, a scanner housing 19 mounted on the printer housing 11, and a document cover 12 mounted on the scanner housing 19. The document cover 12 is supported on the scanner housing 19 such that the document cover 12 can be opened and closed, so that a document sheet can be placed between the document cover 12 and the scanner housing 19. The scanner housing 19 houses a scanner (not shown) that scans an image on the document sheet placed between the document cover 12 and the scanner housing 19 and captures the image. The scanner housing 19 that houses the scanner is supported on the printer housing 11, which has the shape of a box that is open at the top, such that the scanner housing 19 can be opened and closed. The scanner housing 19 is opened and closed, for example, for maintenance.

The printer housing 11 has a recess 11A which receives a tray unit 13 (see FIG. 2), which is not shown in FIG. 1, at a lower area thereof. The recess 11A is open frontward, and left and right walls defining the recess 11A has guiderails (not shown). The guiderails support the tray unit 13 such that the tray unit 13 can be pulled out. The tray unit 13 may be detached completely from the printer housing 11 or may be supported by the printer housing 11 over the sliding range. Sheets are placed on the tray unit 13 by a user. The sheets placed on the tray unit 13 are subjected to image recording by a printer 20.

Figure 2:
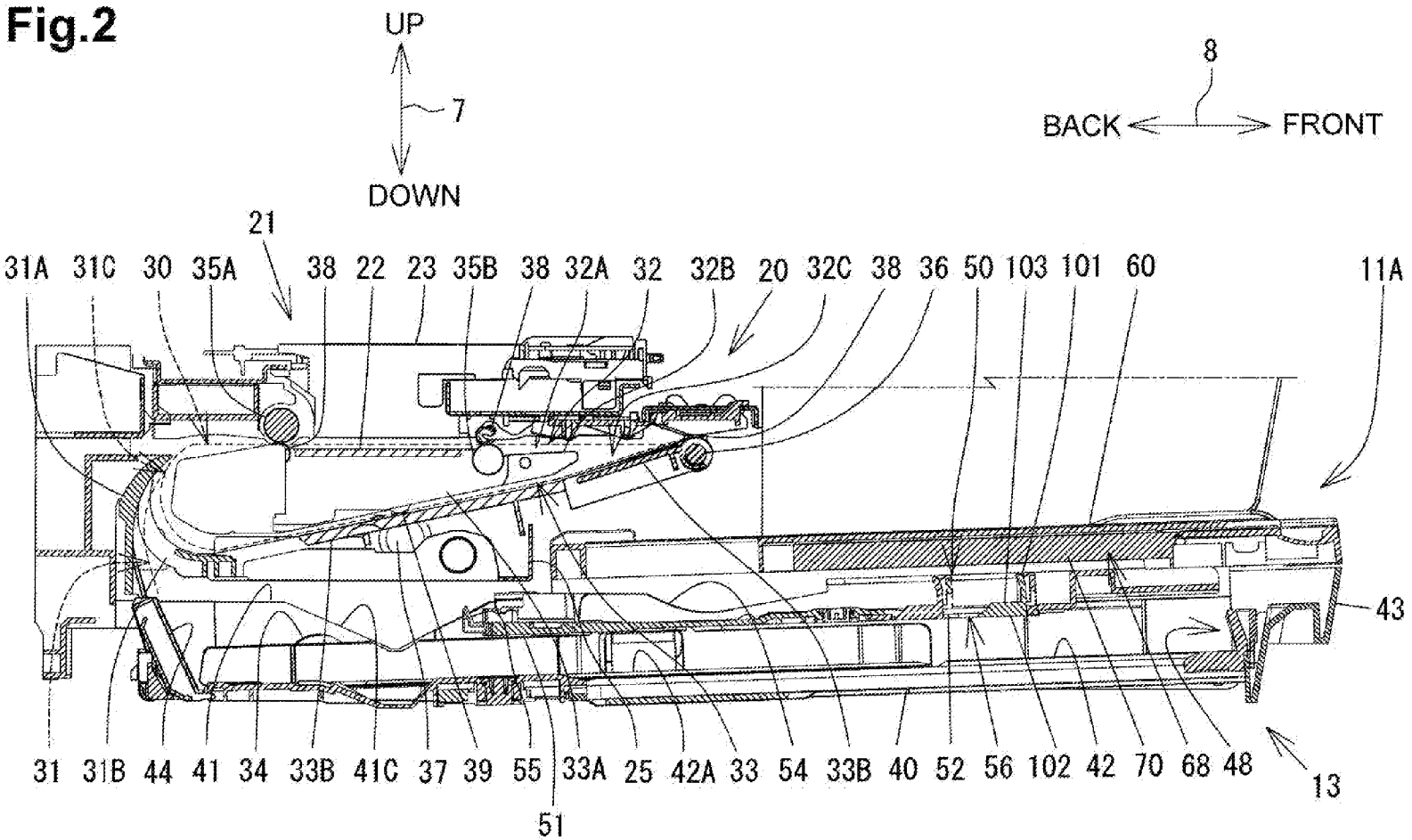
FIG. 2 is a cross-sectional view of a housing of the image recording device when a second tray is in a second position.

Referring to FIG. 2, the printer 20 comprises feed rollers 34 that feed the sheets from the tray unit 13; a convey path 30 along which the sheets that have been fed are conveyed; a recording unit 21 that records images on the sheets that are conveyed; a housing 25 that supports the recording unit 21; a drive unit (not shown) that drives movable members, such as a recording head 23 included in the recording unit 21; and a control unit that controls the drive unit, the recording unit 21, and the scanner.

The drive unit includes a plurality of drive motors and a driving force transmitting mechanism that transmits the driving force of the drive motors to the above-described movable members. The control unit includes a microcomputer and various electronic components mounted on a control board. The control unit receives signals from an operation panel 14 shown in FIG. 1, which is mounted on the printer housing 11, or an external device, such as a personal computer. The control unit performs, upon receipt of the signals, capturing images through the scanner, transmitting the captured images to the personal computer, telephone lines, etc., and recording images on the sheets with the printer 20.

Figure 9:
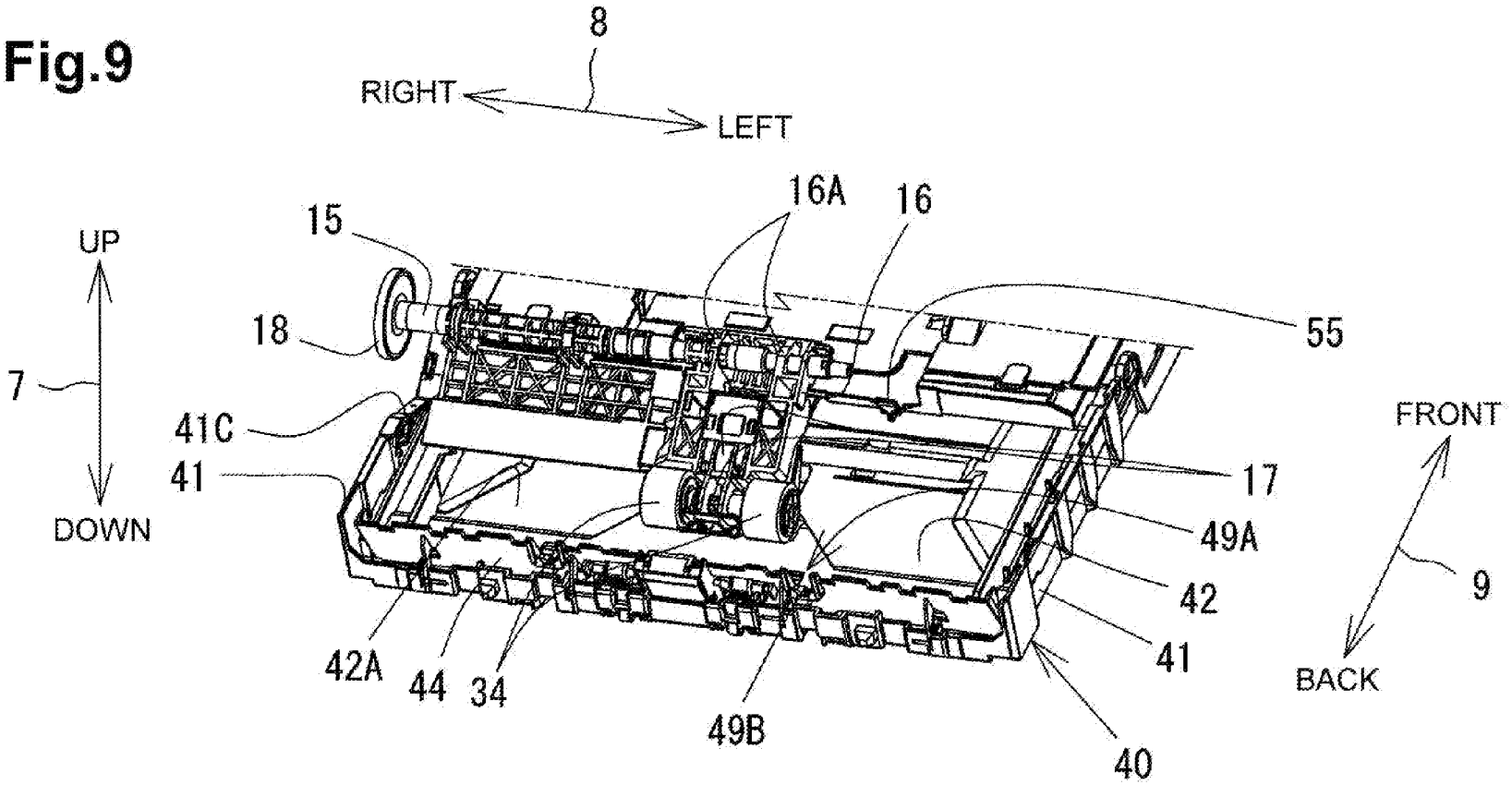
FIG. 9 is a perspective view of feed rollers of the image recording device.

The printer 20 comprises feed rollers 34 disposed above a back portion of the tray unit 13 mounted in the printer housing 11. The feed rollers 34 are supported by a shaft 15 and an arm 16, as shown in FIG. 9. The shaft 15 is disposed in front of and above the feed rollers 34, extends in the left-right direction 9, and is rotatably supported by the housing 25. The shaft 15 comprises, at one end thereof in the left-right direction 9, a gear 18 rotated by the above-described drive unit. The rotation of the shaft 15 is transmitted to the feed rollers 34 through the arm 16, as described below. The arm 16 comprises, at one end thereof, ring-shaped receiving portions 16A through which the shaft 15 is inserted, and the left and right feed rollers 34 are rotatably attached to the other end of the arm 16. The arm 16 pivots around the shaft 15 such that the feed rollers 34 move vertically. A plurality of transmission gears 17 that mesh with each other are rotatably provided between the above-mentioned ends of the arm 16. The rotation of the shaft 15 is transmitted to the feed rollers 34 through the transmission gears 17. The arm 16 is urged by an elastic member (not shown), such as a torsional coil spring, in one of the pivoting directions, such that the feed rollers 34 are urged downward. The feed rollers 34 that are urged downward so as to press the sheets placed on the tray unit 13. Accordingly, the sheets are fed toward the convey path 30 when the feed rollers 34 are rotated. The feed rollers 34 are an example of a feeder.

As shown in FIG. 2, the convey path 30 includes a feed path 31, a discharge path 32, and a return path 33. The feed path 31 has an arch shape in cross section such that a first end thereof is positioned behind the tray unit 13 mounted in the printer housing 11 and that a second end thereof is positioned above the first end. The discharge path 32 extends frontward linearly from the feed path 31. The return path 33 is formed between the discharge path 32 and the feed path 31.

The feed path 31 is defined by an outer support member 31A and an inner support member 31B, each of which has an arc shape in cross section. The support member 31B has a merging port 31C with which a first end of the return path 33 merges. The discharge path 32 is defined by a support member 32B that is disposed in front of a platen 22, which is disposed in front of the second end of the feed path 31, and a support member 32A that is disposed above the support member 32B. The support members 32A and 32B are supported by the housing 25.

A convey roller 35A, a discharge roller 35B, and a switchback roller 36 that are rotated by the above-described drive unit are provided along the convey path 30. The convey roller 35A is disposed behind the platen 22, and the discharge roller 35B is disposed between the platen 22 and the support member 32B that is disposed in front of the platen 22. The switchback roller 36 is disposed in front of the support member 32B and above a central area of the tray unit 13 in the front-back direction 8. A merging port 32C with which a second end of the return path 33 merges is formed between the switchback roller 36 and the support member 32B.

The convey roller 35A, the discharge roller 35B, and the switchback roller 36 are opposed to respective rollers 38, as shown in FIG. 2. Each sheet fed to the feed path 31 is conveyed forward along the platen 22 by the convey roller 35A and the discharge roller 35B, and an image is recorded on a first side of the sheet by the recording unit 21, which will be described below. Then, the sheet is discharged by the switchback roller 36 in the case of single-sided printing. In the case of double-sided printing, the switchback roller 36 is rotated in the reverse direction, so that the sheet is moved in the reverse direction and conveyed to the return path 33 through the merging port 32C. The switchback roller 36 is an example of a discharging unit.

The reverse path 33 is defined by support members 33A and 33B, which are supported by the housing 25, and is formed so as to extend below the platen 22. The reverse path 33 is provided with a convey roller 37 that is rotated by the above-described drive unit and a roller 39 opposed to the convey roller 37. The sheet that has entered the return path 33 through the merging port 32C is conveyed to the feed path 31 by the convey roller 37 and the roller 39 such that the sheet is turned over. Then, the sheet is conveyed along the platen 22 again and an image is formed on a second side of the sheet by the recording unit 21.

The recording unit 21 comprises the platen 22, which is plate-shaped and disposed above the feed rollers 34 and in front of the second end of the feed path 31; the recording head 23 disposed above the platen 22 so as to face the platen 22; and a rail unit (not shown) that supports the recording head 23 such that the recording head 23 is movable in the left-right direction 9. The rail unit is supported by the housing 25.

The recording head 23 may be, for example, an inkjet recording head. The recording head 23 is moved in the left-right direction 9 by the above-described drive unit, and ejects ink toward the platen 22 that is disposed below the recording head 23. Owing to the movement of the recording head 23 in the left-right direction 9 and the forward movement of the sheet, an image can be recorded over substantially the entire area of the top surface of the sheet that is conveyed along the platen 22. The image may be recorded by a recording method other than the inkjet recording method.

The tray unit 13 is configured to hold two types of sheets, which are first sheets and second sheets, and to receive sheets discharged by the switchback roller 36. The structure of the tray unit 13 will be described in detail below.

As shown in FIGS. 2 to 5, the tray unit 13 comprises a main tray 40 disposed at the bottom and configured to hold the first sheets, a second tray 50 disposed at an intermediate position and configured to hold the second sheets, and a discharge tray 60 disposed at the top and configured to receive the sheets discharged by the switchback roller 36. The main tray 40 is a example of a first tray, the second tray 50 is an example of a second tray, and the discharge tray 60 is an example of a third tray.

Flexible sheets, such as recording sheets and plastic sheets, are used as the above-described sheets. The recording sheets are, for example, A4-size sheets, B5-size sheets, cards, and envelopes. In the present embodiment, the main tray 40 is configured to receive A4-size and B5-size sheets, and the second tray 50 is configured to receive small sheets, such as cards. However, the main tray 40 and the second tray 50 may be configured such that the same type of sheets can be placed on the main tray 40 and the second tray 50.

The main tray 40 is formed of a synthetic resin material in the shape of a box that is open upward, and includes a rectangular plate-shaped bottom 42 on which the first sheets are placed, a front wall 43, a back wall 44, and left and right side walls 41. The first sheets are placed on an inner bottom surface 42A of the main tray 40. The inner bottom surface 42A is an example of a first holding surface.

A rear guide mechanism 48 and a side guide mechanism 45 (see FIG. 7) for positioning the first sheets placed on the bottom 42 of the main tray 40 in the front-back direction 8 and the left-right direction 9 are provided on the bottom 42 of the main tray 40. The structures of the rear guide mechanism 48 and the side guide mechanism 45 are similar to those of a rear guide mechanism 100 and a side guide mechanism 110 (see FIG. 6) provided on the second tray 50, and explanations thereof are thus omitted here.

The back wall 44 of the main tray 40 is inclined with respect to the bottom 42 such that the back wall 44 extends obliquely upward and backward from the back end of the bottom 42. The back wall 44 guides each sheet fed by the feed rollers 34 to the feed path 31 along the inner surface thereof. A plurality of separating projections 47 project from the inner surface of the back wall 44. The separating projections 47 come into contact with the leading edge of the sheet fed by the feed rollers 34 in a sheet feed direction, and separate the top sheet from the remaining sheets.

The back wall 44 of the main tray 40 has left and right notches 49A for positioning the second tray 50 in the left-right direction 9. Engagement pieces 55 provided on the second tray 50 are configured to be fitted to the notches 49A. A retaining lug 49B is formed in each notch 49A so as to retain the second tray 50. The retaining lug 49B engages with an engaging portion (not shown) of the engagement piece 55 of the second tray 50.

Each of the left and right side walls 41 of the main tray 40 has a rail 41A on an inner surface thereof. The rails 41A support the second tray 50 such that the second tray 50 is movable in the front-back direction 8. The right side wall 41 of the main tray 40 has, as a part of a top surface thereof, an inclined surface 41C whose height decreases toward the front. When the tray unit 13 is inserted into or pulled out from the printer housing 11, the above-described arm 16 that supports the feed rollers 34 makes slide contact with the inclined surface 41C. Owing to the inclined surface 41C, the feed rollers 34 are raised when the tray unit 13 is pulled out from the printer housing 11, and are lowered when the tray unit 13 is inserted into the printer housing 11. The side walls 41 of the main tray 40 have left and right shaft holes 41B that support shafts 63 provided on the discharge tray 60. Owing to the shaft holes 41B, the discharge tray 60 is supported on the main tray 40 in a pivotable manner.

Figure 4:
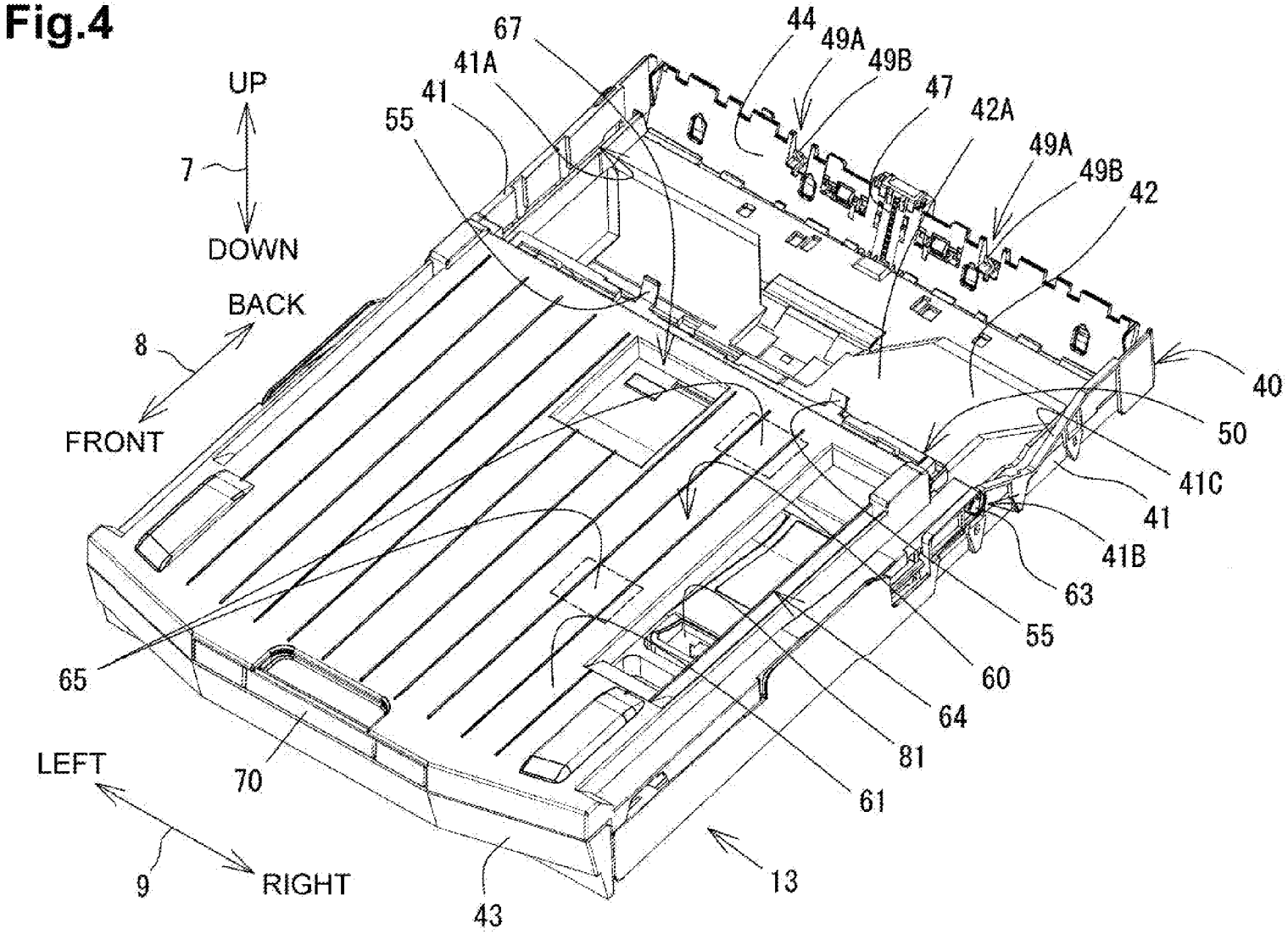
FIG. 4 is a perspective view of a tray unit of the image recording device when the second tray is in the second position.

The discharge tray 60 comprises a rectangular plate-shaped base 61 and guiderails 62 that are formed integrally with the base 61. A guiding surface of each guide rail 62 faces the base 61 in the thickness direction of the base 61. The discharge tray 60 is formed of, for example, a synthetic resin material. As shown in FIG. 4, the dimension of the base 61 in the front-back direction 8 is smaller than the dimension of the main tray 40 in the front-back direction 8. The left and right shafts 63 that are inserted into the shaft holes 41B in the main tray 40 project from the back ends of the left and right side surfaces of the base 61. The discharge tray 60 pivots around the shafts 63 between a lying position shown in FIG. 4 and a standing position shown in FIG. 7. The discharge tray 60 in the lying position extends along the inner bottom surface 42A of the main tray 40 and covers an opening at the front area of the main tray 40. When the discharge tray 60 is in the standing position, the opening at the front area of the main tray 40 is exposed.

Figure 7:
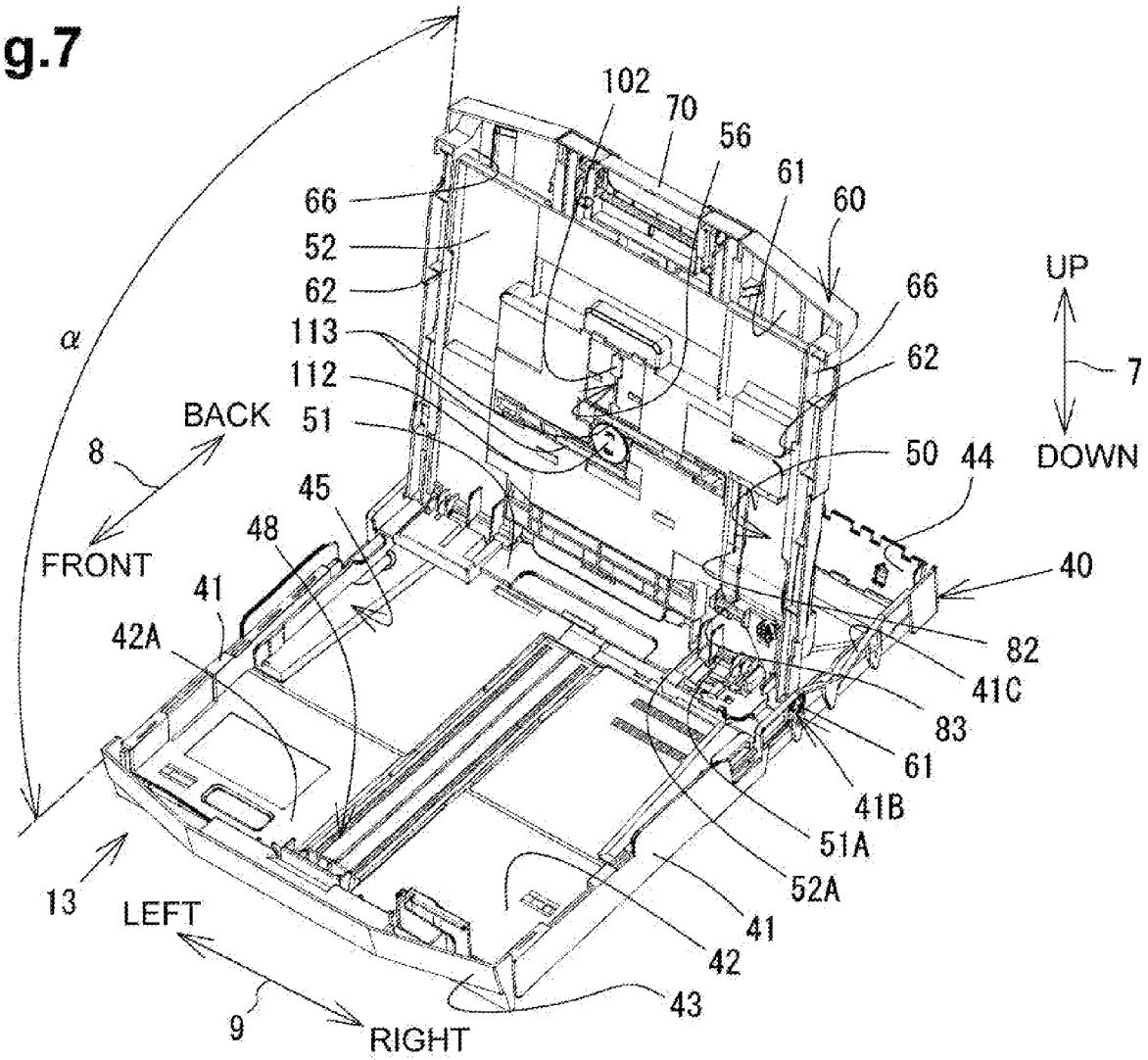
FIG. 7 is a perspective view of the tray unit when the discharge tray is opened and pivoted upward.

As shown in FIG. 4, when the discharge tray 60 is in the lying position and is closed, the discharge tray 60 is supported by the side walls 41 and the front wall 43 of the main tray 40. As shown in FIG. 7, when the discharge tray 60 is in the standing position and is opened, the discharge tray 60 stands upward with respect to the inner bottom surface 42A of the main tray 40. In this state, bottom end portions of the discharge tray 60 in FIG. 7 may contact the side walls 41 of the main tray 40 or the second tray 50 so that the discharge tray 60 is supported. When the tray unit 13 is mounted in the printer housing 11, the discharge tray 60 is in the lying position. A user pulls out the tray unit 13 from the printer housing 11, opens the discharge tray 60, and loads the first sheets into the main tray 40. After the first sheets are loaded, the user closes the discharge tray 60 and mount the tray unit 13 into the printer housing 11.

An opening angle $\alpha$ (see FIG. 7) of the discharge tray 60 is set to about 100 degrees. When the opening angle of the discharge tray 60 reaches about 100 degrees, a restraining portion (not shown) comes into contact with the discharge tray 60 to restrain the discharge tray 60 from pivoting any further. The restraining portion is formed on the second tray 50 or the main tray 40. Alternatively, a stopper that stops the pivoting of the discharge tray 60 may be provided on the shafts 63 of the discharge tray 60. When the opening angle $\alpha$ is set to be equal to or greater than 90 degrees, the discharge tray 60 can be maintained in the standing position. Therefore, the first sheets can be easily supplied to the main tray 40. The opening angle $\alpha$ may be set to any angle in the range of 90 degrees to 180 degrees. However, the opening angle $\alpha$ is preferably 95 degrees or more to prevent the discharge tray 60 from being closed by accident, and is preferably 110 degrees or less so that the discharge tray 60 can be closed easily.

As described above, the switchback roller 36 is disposed above the central area of the tray unit 13 in the front-back direction 8. Therefore, the sheets discharged from the switchback roller 36 are stacked on the base 61 of the discharge tray 60 in the lying position. The vertical position of the base 61 of the discharge tray 60 in the lying position is set such that the distance between the discharge tray 60 and the switchback roller 36 in the up-down direction 7 is sufficiently small so that the sheets discharged from the switchback roller 36 is prevented from being curled or bent. In the present embodiment, since the discharge tray 60 is positioned near the switchback roller 36, the discharge tray 60 is opposed to the housing 25 in the front-back direction 8. Since the discharge tray 60 is formed separately from the second tray 50 and does not slide together with the second tray 50, as described above, the discharge tray 60 does not come into contact with the housing 25. Thus, in the multifunction device 10, the discharge tray 60 is prevented from colliding with the housing 25 and the sheets can be discharged properly.

A long hole 64 through which an operation lever 81 is exposed upward is formed in the base 61 of the discharge tray 60. The long hole 64 has a rectangular shape that extends in the front-back direction 8 when the discharge tray 60 is in the lying position. The long hole 64 is an example of a first opening.

Marks 65 are provided adjacent to the long hole 64. Each mark 65 may include characters or graphic patterns engraved in the base 61 of the discharge tray 60 or may comprise adhesive pieces, such as stickers, attached to the base 61. The adhesive pieces may include characters or graphic patterns printed thereon. The marks 65 allow the user to readily recognize whether the second tray 50 is in a first position or a second position, as described below.

A hole 67 through which a rear guide 101 is exposed upward is also formed in the base 61 of the discharge tray 60. The hole 67 is an example of a second opening.

As shown in FIG. 7, each guiderail 62 of the discharge tray 60 is connected to the base 61 of the discharge tray 60 by a corresponding one of support ribs 66 provided on the base 61. When the discharge tray 60 is in the lying position, the support ribs 66 are disposed at left and right end portions of the bottom surface of the base 61 (surface facing the second tray 50), and extend in the front-back direction 8. Each guiderail 62 is a plate-shaped member that extends in the front-back direction 8 and the left-right direction 9, and is connected to the corresponding support rib 66 at the central area of the support rib 66 in the front-back direction 8. The guiderails 62 are formed at such positions that the guiderails 62 are below the second tray 50 in either cases where the second tray 50 is in the first position or in the second position.

The guiderails 62 project from the projecting ends of the left and right support ribs 66 in a direction in which the support ribs 66 are opposed to each other. The guiderails 62 support left and right end portions of a pivoting portion 52 of the second tray 50. Each of the left and right end portions of the second tray 50 is sandwiched between the guiderail 62 and a portion of the base 61 that faces the guiderail 62. More specifically, when the discharge tray 60 is in the lying position, the base 61 is positioned above the second tray 50 and the guiderails 62 are positioned below the second tray 50. At this time, the top surfaces of the guiderails 62 are in contact with the second tray 50, but the base 61 is not in contact with the second tray 50. The guiderails 62 and the left and right end portions of the base 61 are an example of a coupling member.

As shown in FIG. 2, a storing portion 68 which stores an auxiliary tray 70 is provided at a front portion of the discharge tray 60. The storing portion 68 is defined by the front portion of the base 61 and guiderails (not shown) that extend along the bottom surface of the base 61. The guiderails extend in the front-back direction 8 in FIG. 2, and the auxiliary tray 70 is placed between the front portion of the base 61 and the guiderails. The auxiliary tray 70 moves along the front-back direction 8 between a stored position in which the auxiliary tray 70 is stored in the storing portion 68 and a projecting position in which the auxiliary tray 70 is pulled out from the storing portion 68 and is projecting frontward.

When the auxiliary tray 70 is pulled out from the discharge tray 60, the auxiliary tray 70 receives the sheets discharged from the switchback roller 36 in cooperation with the discharge tray 60. When the number of sheets on which images are to be recorded is relatively small or when images are recorded on relatively small sheets, such as B5-size sheets, the user can place the auxiliary tray 70 in the storing portion 68 so that the overall size of the multifunction device 10 can be reduced. When the number of sheets on which images are to be recorded is relatively large or when images are recorded on relatively large sheets, such as A4-size sheets, the user can pull out the auxiliary tray 70 so that the sheets can be reliably received. This allows the multifunction device 10 to handle a large number of sheets and large sheets while the device 10 remains relatively compact. Instead of sliding the auxiliary tray 70 to change the position thereof, the auxiliary tray 70 may be pivoted or detachably attached.

As shown in FIG. 7, the second tray 50 comprises a sliding portion 51, the pivoting portion 52, and the operation lever 81. The sliding portion 51 is supported by the rails 41A provided on the main tray 40 such that the sliding portion 51 is movable in the front-back direction 8. The pivoting portion 52 comprises a shaft receiver 52A that receives a shaft 51A provided on the sliding portion 51. The pivoting portion 52 is slidable integrally with the sliding portion 51, and is pivotable about the shaft 51A with respect to the sliding portion 51. The operation lever 81 is connected to the pivoting portion 52, and is movable integrally with the pivoting portion 52. The second sheets are placed on the top surface of the sliding portion 51 and the top surface of the pivoting portion 52 in FIG. 6. The top surface of the sliding portion 51 and the top surface of the pivoting portion 52 are an example of a second holding surface.

As described below, the sliding portion 51 is slid by the user when the sheets subjected to image recording are switched between the first sheets and the second sheets. The pivoting portion 52 is pivoted integrally with the discharge tray 60 by the user in order to load the first sheets into the main tray 40. The operation lever 81 is operated by the user in order to slide the sliding portion 51.

The pivoting portion 52 is plate-shaped and is formed of synthetic resin or the like. The second sheets are placed on the pivoting portion 52. When the sliding portion 51 is moved in the front-back direction 8 between a front position and a back position, the pivoting portion 52 moves integrally with the sliding portion 51. The second tray 50 is described as being in a first position when the sliding portion 51 is in the back position and the pivoting portion 52 is above the back area of the bottom 42 of the main tray 40, and the second tray 50 is described as being in a second position when the sliding portion 51 is in the front position and the pivoting portion 52 is positioned above the front area of the bottom 42. When the second tray 50 is in the first position, a front end portion of the pivoting portion 52 is supported by the guiderails 62 of the discharge tray 60. In other words, the guiderails 62 are positioned below the front end portion of the pivoting portion 52. At this time, a back end portion of the pivoting portion 52 is supported by the sliding portion 51. When the second tray 50 is in the second position, the pivoting portion 52 is supported by the guiderails 62. In other words, the guiderails 62 are positioned below the pivoting portion 52. The top surfaces of the guiderails 62, which face the base 61, are formed so as to cross a pivoting direction of the pivoting portion 52 when the second tray 50 is in the first position, that is, a circumferential direction centered on the shaft 51A.

Figure 3:
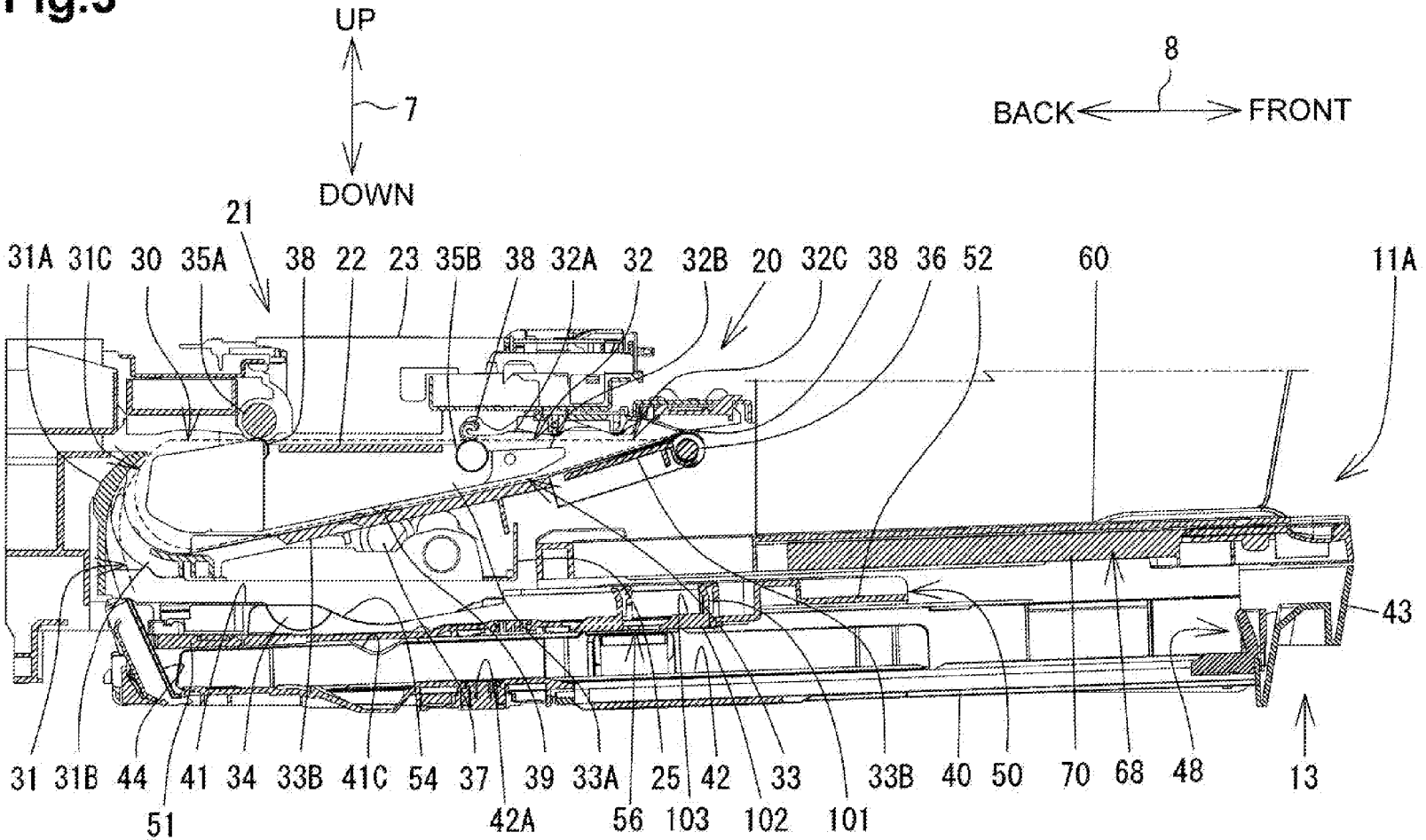
FIG. 3 is a cross-sectional view of the housing when the second tray is in a first position.
Figure 6:
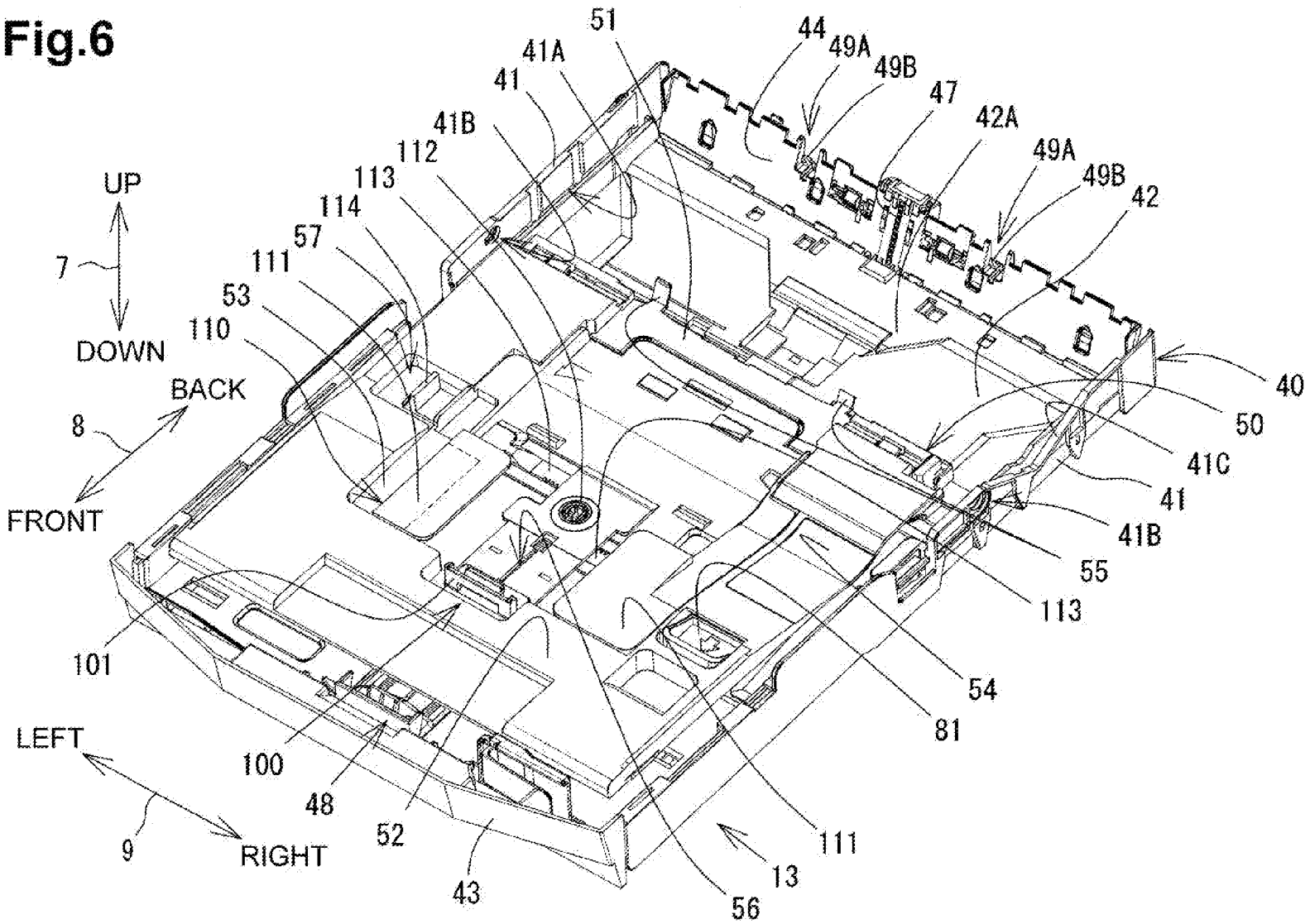
FIG. 6 is a perspective view of the tray unit when a discharge tray is removed.

As shown in FIGS. 3 and 6, the top surface of the pivoting portion 52 has an inclined surface 54 whose height decreases toward the front. The arm 16 that supports the feed rollers 34 makes slide contact with the inclined surface 54 when the tray unit 13 is inserted into or pulled out from the printer housing 11 while the second tray 50 is in the first position. Owing to the inclined surface 54, the feed rollers 34 are raised when the tray unit 13 is pulled out from the printer housing 11, and are lowered when the tray unit 13 is inserted into the printer housing 11. The feed rollers 34 are vertically moved by the inclined surface 54 when the second tray 50 is in the first position, and is vertically moved by the inclined surface 41C of the side wall 41 of the main tray 40 when the second tray 50 is in the second position.

When the second tray 50 is in the second position, the back area of the main tray 40 is exposed upward. Therefore, the feed rollers 34 are pressed against the first sheets placed on the bottom 42 of the main tray 40 and feed the first sheets toward the feed path 31. Thus, when the second tray 50 is in the second position, images are recorded on the first sheets. When the second tray 50 is in the first position, the pivoting portion 52 is placed between the back area of the bottom 42 of the main tray 40 and the feed rollers 34. Therefore, the feed rollers 34 are pressed against the second sheets placed on the pivoting portion 52 and feed the second sheets toward the feed path 31. Thus, when the second tray 50 is in the first position, images are recorded on the second sheets.

Figure 5:
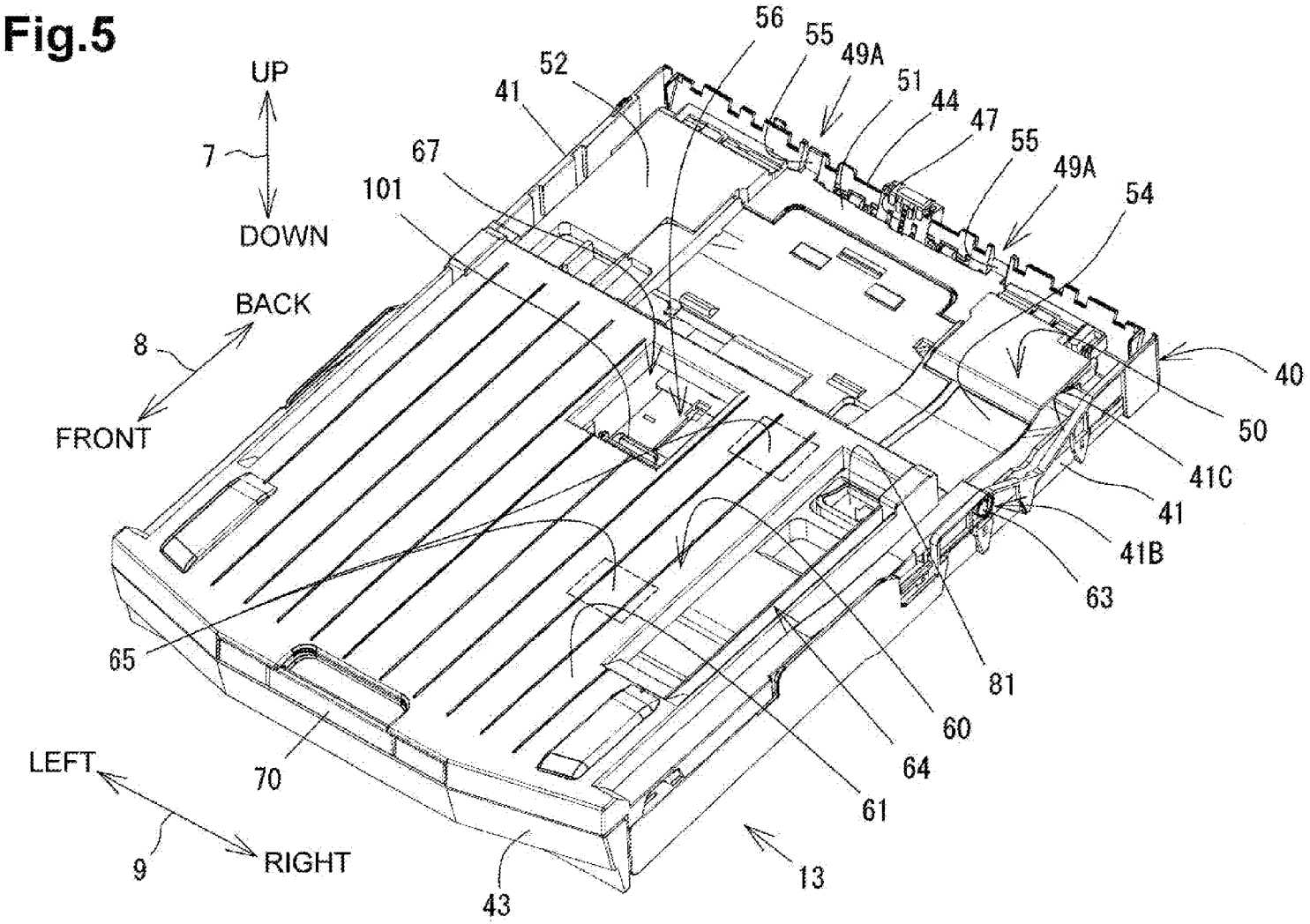
FIG. 5 is a perspective view of the tray unit when the second tray is in the first position.

As shown in FIG. 5, the pivoting portion 52 comprises engagement pieces 55 that are fitted to the notches 49A of the main tray 40 when the second tray 50 is in the first position. Each engagement piece 55 includes a lug (not shown) that engage with the corresponding retaining lug 49B provided on the main tray 40. The engagement pieces 55 project upward from the back end of the pivoting portion 52, and support the bottom edges of the second sheets placed on the pivoting portion 52 when the pivoting portion 52 is pivoted. Thus, the engagement pieces 55 have a function of retaining and positioning the second tray 50 in the first position and a function of preventing the second sheets from falling.

As shown in FIG. 6, the pivoting portion 52 has a long hole 56 for guiding the rear guide 101 of the rear guide mechanism 100 that positions the second sheets placed on the pivoting portion 52; fitting recesses 53 in which side guides 111 of the rear guide mechanism 100 are fitted; and an operation recess 57 in which a lug 114 of the side guide mechanism 110 is fitted. The long hole 56 is formed in the pivoting portion 52 at the central area thereof in the left-right direction 9 and extends in the front-back direction 8. The fitting recesses 53 are formed at left and right sides of the top surface of the pivoting portion 52. The operation recess 57 is formed at the left side of the top surface of the pivoting portion 52.

Referring to FIGS. 6 and 7, the rear guide mechanism 100 includes the rear guide 101 that extends over the peripheral walls at the left and right sides of the long hole 75; a guide piece 103 (see FIG. 2) that projects downward from the rear guide 101 so as to extend through the long hole 56; and a retaining portion 102 arranged such that the peripheral walls at the left and right sides of the long hole 56 are placed between the rear guide 101 and the retaining portion 102. Thus, the rear guide 101 is supported by the pivoting portion 52 such that the rear guide 101 is slidable in the direction in which the long hole 56 extends. The user holds and moves the rear guide 101 such that the second sheets placed on the pivoting portion 52 are held between the rear guide 101 and the engagement pieces 55, thereby positioning the second sheets in the front-back direction 8. The rear guide 101 is an example of a positioning member.

The side guide mechanism 110 includes a pinion gear 112 that is rotatably retained at the central area of the pivoting portion 52 in the left-right direction 9; the left and right side guides 111 arranged at the left and right sides of the pinion gear 112; left and right rack gears 113, each of which is coupled to the corresponding side guide 111 at one end thereof and is meshed with the pinion gear 112 at the other end thereof; and the lug 114 that is connected to the left side guide 111 and disposed in the above-described operation recess 57.

The dimension of the lug 114 in the left-right direction 9 is smaller than the dimension of the operation recess 57 in the left-right direction 9, and the lug 114 is movable in the left-right direction 9. When the user moves the lug 114 rightward or leftward, the left side guide 111 is moved accordingly. The left rack gear 113 is moved together with the movement of the left side guide 111, and the pinion gear 112, which meshes with the left rack gear 113, is rotated by the movement of the left rack gear 113. Accordingly, the right rack gear 113 that meshes with the pinion gear 112 is moved leftward or rightward in response to the rotation of the pinion gear 112. Thus, the pair of side guides 111 are moved toward or away from each other in association with each other. The second sheets are positioned by the side guide mechanism 110 such that the second sheets are centered on the center of the second tray 50 in the left-right direction 9. When the pivoting portion 52 of the second tray 50 is pivoted, the side guides 111 retain the second sheets together with the engagement pieces 55 to prevent the second sheets from falling.

The rear guide mechanism 48 and the side guide mechanism 45 provided on the main tray 40 have structures similar to those of the rear guide mechanism 100 and the side guide mechanism 110 provided on the second tray 50. Instead of positioning the sheets such that the sheets are centered, the sheets may be positioned by the side guide mechanisms 45 and 110 such that left or right edges of the sheets are aligned with a left or right end of the main tray 40 or the second tray 50.

The shaft 51A of the sliding portion 51 of the second tray 50 is positioned such that the shaft 51A is aligned with the shafts 63 of the discharge tray 60 when the second tray 50 is in the second position. In other words, when the second tray 50 is in the second position, the pivot axis of the pivoting portion 52 coincides, in position, with the pivot axis of the discharge tray 60. In addition, when the second tray 50 is in the second position, the pivoting portion 52 is placed between the base 61 and the guiderails 62 of the discharge tray 60 in the up-down direction 7. Therefore, when the discharge tray 60 is opened by the user, the top surfaces of the guiderails 62 come into contact with the bottom surface of the second tray 50, and the second tray 50 is opened integrally with the discharge tray 60. Thus, the user can open the discharge tray 60 and the pivoting portion 52 together to expose the front area of the main tray 40. Thus, user-friendliness can be increased compared to an image recording device in which the discharge tray 60 and the second tray 50 are opened individually. In addition, the structure in which the second tray 50 is both slidable and pivotable and in which the second tray 50 is pivotable integrally with the discharge tray 60 is realized simply by dividing the second tray 50 into the sliding portion 51 and the pivoting portion 52. It is not necessary that the pivot axis of the pivoting portion 52 and the pivot axis of the discharge tray 60 precisely coincide, in position, with each other as long as the second tray 50 is pivotable integrally with the discharge tray 60. However, when the pivot axes coincide, in position, with each other, relative displacements between the pivoting portion 52 and the discharge tray 60 can be reduced when the pivoting portion 52 and the discharge tray 60 are pivoted together. Accordingly, the pivoting portion 52 and the discharge tray 60 can be appropriately integrated with each other and be smoothly pivoted. Instead of the guiderails 62 that restrain pivoting of the second tray 50 when the second tray 50 is in the first position, ribs may be provided on the main tray 40 to restrain pivoting of the pivoting portion 52. The ribs may project from the inner surfaces of the left and right side walls 41 of the main tray 40 and come into contact with the top surface of the pivoting portion 52 when the second tray 50 is in the first position.

When the second tray 50 is in the first position, the discharge tray 60 is restrained from pivoting. However, it is not necessary to make the discharge tray 60 completely non-pivotable as long as pivoting thereof is restrained such that the sheets cannot be supplied to the main tray 40. The degree of restraining the discharge tray 60 from pivoting can be adjusted by changing the shape, location, etc. of a coupling portion, e.g., the guiderails 62 and the base 61, of the discharge tray to the second tray 50. It is not necessary that the guiderails 62 and the base 61 be constantly in contact with the second tray 50 as long as the guiderails 62 and the base 61 become coupled to or come into contact with the second tray 50 when the discharge tray 60 is pivoted.

When the second tray 50 is moved from the second position to the first position, the pivot axis of the pivoting portion 52 is moved away from the pivot axis of the discharge tray 60 in the front-back direction 8. In addition, as described above, when the second tray 50 is in the first position, the front end portion of the pivoting portion 52 is placed between the base 61 of the discharge tray 60 and the guiderails 62 in the vertical direction, and the back end portion of the pivoting portion 52 is supported by the sliding portion 51. This disables the pivoting portion 52 to pivot. Since the top surfaces of the guiderails 62 and the bottom surface of the base 61 of the discharge tray 60 cross the pivoting direction of the pivoting portion 52, the pivoting portion 52 is effectively restrained from pivoting. Since the pivoting portion 52 cannot pivot, the discharge tray 60, which holds the pivoting portion 52 in a sandwich manner, cannot pivot either. Thus, when the second tray 50 is in the first position and the second sheets placed on the second tray 50 are subjected to image recording, the discharge tray 60 cannot be opened. Accordingly, the second sheets, which are to be supplied to the second tray 50, can be prevented from being supplied to the main tray 40 by mistake. Each of the top surfaces of the guiderails 62 and the bottom surface of the base 61 of the discharge tray 60 are an example of two surfaces for sandwiching the pivoting portion 52 when the second tray 50 is in the second position and the discharge tray 60 is in the lying position. Further, ribs may be provided on the main tray 40 such that the ribs project from the inner surfaces of the left and right side walls 41 and come into contact with the top surface of the pivoting portion 52 when the second tray 50 is not in the second position. These ribs restrain the discharge tray 60 from pivoting even when the second tray 50 has not yet reached the first position.

As shown in FIG. 5, the operation lever 81 of the second tray 50 is positioned such that the operation lever 81 is exposed upward through the long hole 64 in the base 61 of the discharge tray 60. The operation lever 81 is slid by the user. An arrow showing the sliding direction of the second tray 50 is engraved in or printed on the top surface of the operation lever 81. This arrow makes the user to readily recognize the existence of the operation lever 81.

Figure 8:
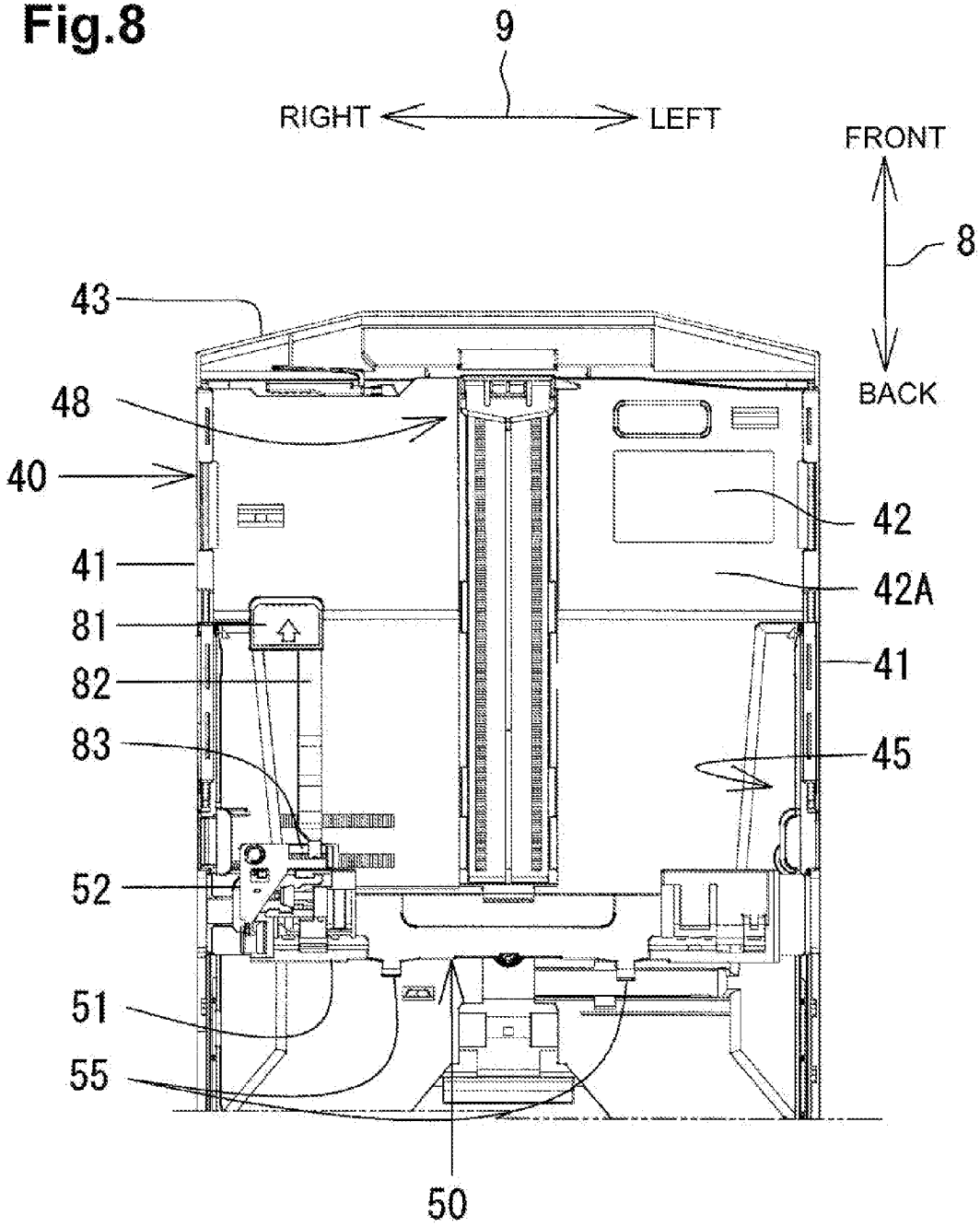
FIG. 8 is a plan view of an operation member of the second tray.

The operation lever 81 is positioned below the top surface of the base 61 of the discharge tray 60 so that the second sheets that have been discharged are prevented from being caught by the operation lever 81. The operation lever 81 is attached to a front end portion of a rectangular plate-shaped connection lever 82 shown in FIG. 8. An attachment member 83 at a back end portion of the connection lever 82 is attached to the pivoting portion 52. Thus, the operation lever 81 is connected to the pivoting portion 52 via the connection lever 82, and is operated to move the second tray 50 in the front-back direction 8. The dimension of the long hole 64 in the front-back direction 8 is substantially the same as the movable distance of the pivoting portion 52 in the front-back direction 8. Accordingly, the user can move the second tray 50 between the first position and the second position by using the operation lever 81. In FIG. 8, only a part of the pivoting portion 52 is shown.

Referring to FIGS. 4 and 5, the marks 65 are provided on the discharge tray 60 at two positions: a position corresponding to the position of the operation lever 81 when the second tray 50 is in the first position and a position corresponding to the position of the operation lever 81 when the second tray 50 is in the second position. More specifically, the marks 65 are provided adjacent to front and back ends of the long hole 64. Each mark 65 shows characters or graphic patterns that allow the user to recognize whether the second tray 50 is in the first position or the second position. Accordingly, the user can recognize whether the images will be recorded on the first sheets or the second sheets from the position of the operation lever 81 and the characters or graphic patterns shown in the marks 65. Alternatively, only one of the two marks 65 may be provided on the discharge tray 60 to show one of the first position and the second position of the second tray 50.

In the multifunction device 10 according to the present embodiment, the tray unit 13, the feed rollers 34, the recording unit 21, and the scanner are arranged in the up-down direction 7. As described above, the discharge tray 60 is prevented from making contact with the housing 25, and the discharge tray 60 can be placed near the switchback roller 36. In addition, the height of the printer housing 11 can be reduced since the discharge tray 60 is configured not to slide under the feed rollers 34. As a result, a multifunction device 10 capable of properly discharging the sheets can be realized without increasing the size thereof. Although the present invention may also be applied to, for example, a printer having only a printing function, the present invention is particularly effective when applied to the multifunction device 10 which has a large height due to the scanner housing 19 placed on the printer housing 11.

The discharge tray 60 and the pivoting portion 52 of the second tray 50 can be opened together to load the first sheets into the main tray 40. Thus, the user-friendliness is increased.

In the case where the second tray 50 is in the first position and the second sheets placed on the second tray 50 are subjected to image recording, the second tray 50 coupled to the discharge tray 60 prevents the discharge tray 60 from being opened. As a result, the second sheets, which are to be loaded into the second tray 50, can be prevented from being loaded into the main tray 40 by mistake.

The discharge tray 60 which can be opened prompts the user to load the first sheets into the main tray 40. The discharge tray 60 which cannot be opened prompts the user to load the second sheets into the second tray 50 from the back side. Thus, the user can recognize the tray into which the sheets are to be loaded depending on whether or not the discharge tray 60 can be opened.

In the present embodiment, the multifunction device 10 including the return path 33 is described as an example of an image recording device in which the vertical position of the switchback roller 36 as a discharge unit is relatively high. However, the present invention can also be applied to an image recording device in which the return path 33 is not provided. For example, the present invention can also be applied to an image recording device in which the vertical position of the switchback roller 36 is relatively high due to a structure for achieving an additional function other than double-sided printing or a structure in which the above-described control board is retained by the housing 25.

In the above-described embodiment, the first sheets having the images recorded thereon and discharged are received by the discharge tray 60. In another embodiment of the invention, the discharged first sheets may be received by the discharge tray 60 and the second tray 50, as described below.

Figure 10A:
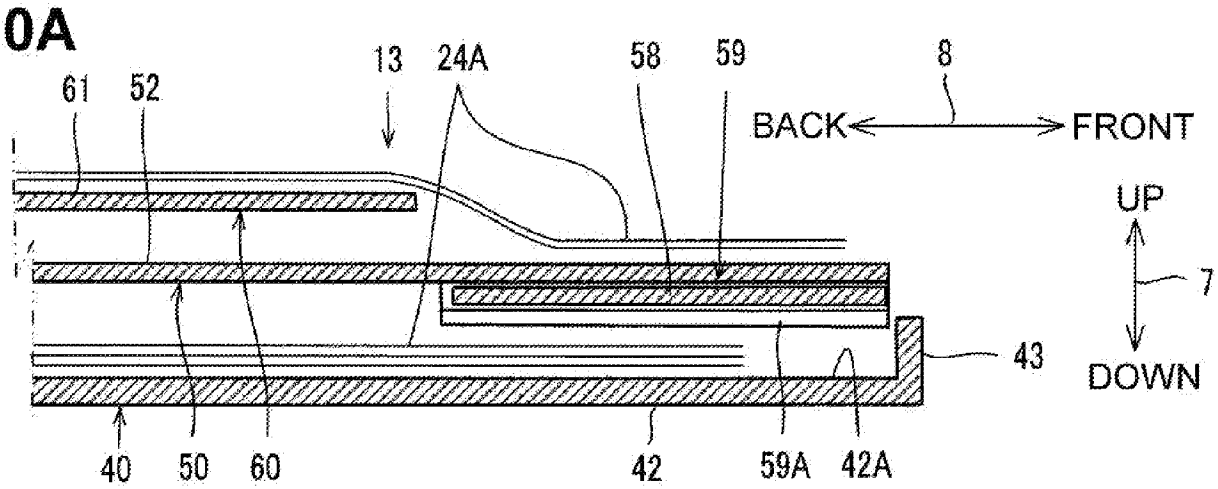
FIGS. 10A and 10B are schematic cross-sectional views of a tray unit according to another embodiment of the invention.
Figure 10B:
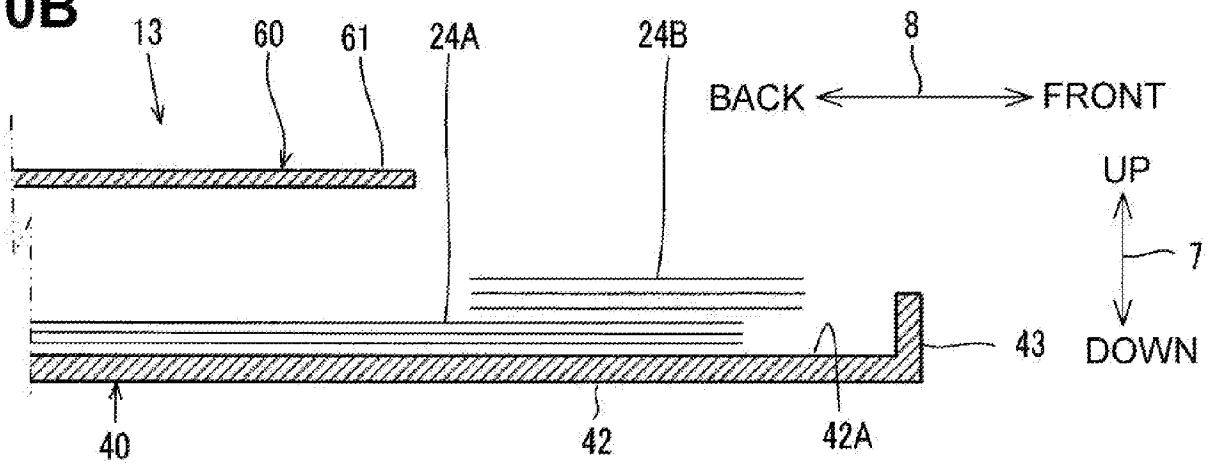

As shown in FIGS. 10A and 10B, the dimension of a base 61 of a discharge tray 60 in the front-back direction 8 is set such that the front end of the base 61 is positioned behind a front wall 43 of a main tray 40. In addition, as shown in FIG. 10A, the dimension of a pivoting portion 52 of a second tray 50 in the front-back direction 8 is set such that when the second tray 50 is in the second position, the front end portion of the pivoting portion 52 is positioned in front of the front end of the base 61. As shown in FIG. 10A, when the second tray 50 is in the second position and first sheets 24A placed on the main tray 40 are subjected to image recording, the first sheets 24A discharged from switchback roller 36 are received by the base 61 of the discharge tray 60 and the front end portion of the pivoting portion 52 of the second tray 50. As shown in FIG. 10B, when the second tray 50 is in the first position and second sheets 24B are subjected to image recording, the second sheets 24B discharged from the switchback roller 36 are received by the main tray 40. As described above, when the first sheets 24A are subjected to image recording, the weight of the discharged first sheets 24A can be distributed between the second tray 50 and the discharge tray 60. Therefore, an increased number of first sheets 24A having the images recorded thereon can be held in a multifunction device 10. The front end portion of the pivoting portion 52 of the second tray 50 is an example of a support portion.

The front end portion of the pivoting portion 52 is visible when the second tray 50 is in the second position and invisible when the second tray 50 is in the first position. Therefore, the user can recognize whether the first sheets 24A or the second sheets 24B are subjected to image recording, depending on whether or not the front end portion is visible.

A storing portion 59 which stores an auxiliary tray 58 is provided in the front portion of the pivoting portion 52 of the second tray 50. As shown in FIG. 10A, the storing portion 59 is defined by the front portion of the pivoting portion 52 and guiderails 59A that extend along the bottom surface of the front portion of the pivoting portion 52. The guiderails 59A extend in the front-back direction 8 and the auxiliary tray 58 is placed between the front portion of the pivoting portion 52 and the guiderails 59A. The auxiliary tray 58 moves along the front-back direction 8 between a stored position in which the second auxiliary tray 58 is stored in the storing portion 59 and a projecting position in which the second auxiliary tray 58 is pulled out from the storing portion 59 and is projecting frontward.

When the second auxiliary tray 58 is pulled out, the auxiliary tray 58 receives the first sheets 24A in cooperation with the discharge tray 60 and the second tray 50 after the images are recorded thereon. When the number of sheets subjected to image recording is relatively small or when images are recorded on relatively small sheets, such as B5-size sheets, the user can place the second auxiliary tray 58 in the storing portion 59 so that the overall size of the multifunction device 10 can be reduced. When the number of sheets subjected to image recording is relatively large or when images are recorded on relatively large sheets, such as A4-size sheets, the user can pull out the second auxiliary tray 58 so that the sheets can be reliably received. This allows the multifunction device 10 to handle a large number of sheets and large sheets while the device 10 remains relatively compact. Instead of sliding the second auxiliary tray 58 to change the position thereof, the second auxiliary tray 58 may be pivoted or detachably attached.

Figure 11A:
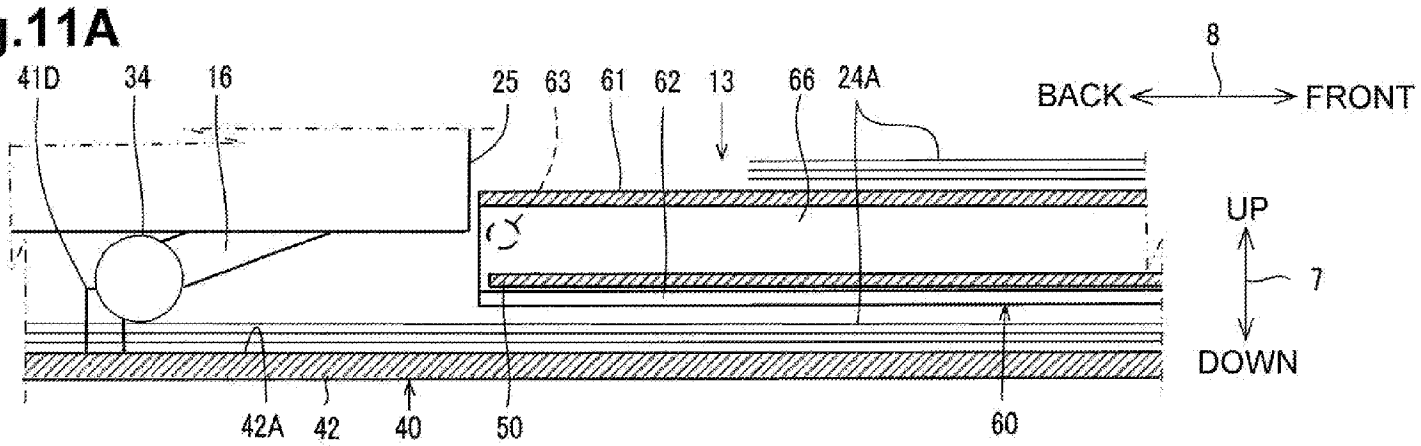
FIGS. 11A and 11B are schematic cross-sectional views of a tray unit according to another embodiment of the invention.
Figure 11B:
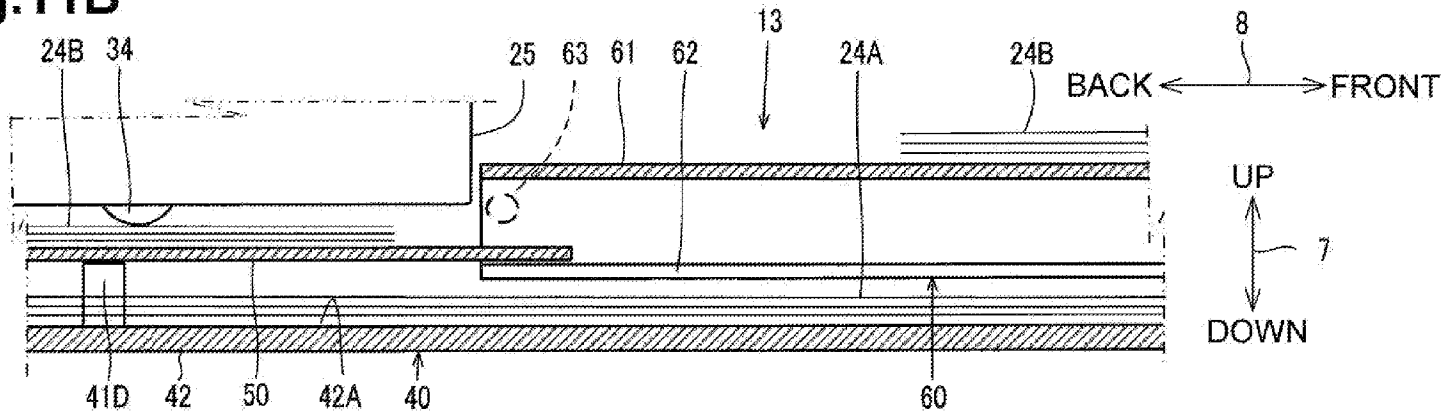

In the embodiment depicted in FIGS. 1-9, the second tray 50 comprises the sliding portion 51 and the pivoting portion 52. In another embodiment of the invention, as shown in FIGS. 11A and 11B, a second tray 50 may be plate-shaped and may be supported by a discharge tray 60 when the second tray 50 is in the second position.

The plate-shaped second tray 50 is slidably supported by guiderails 62 which are provided on the discharge tray 60 similarly to the guiderails 62 shown in FIG. 7. When the second tray 50 is in the second position, the second tray 50 is retained by the guiderails 62. The space surrounded by a base 61 of the discharge tray 60 and the guiderails 62 functions as a storing portion. When the second tray 50 is in the second position, the second tray 50 is stored in the storing portion and is pivotable integrally with the discharge tray 60. When the discharge tray 60 is pivoted, the second tray 50 is stopped by a stopper so as not to project from the discharge tray 60.

When the second tray 50 is in the first position, a front end portion of the second tray 50 is supported by the guiderails 62 and a back portion of the second tray 50 is supported by support portions 41D provided on side walls of a main tray 40. Accordingly, the second tray 50 is not pivotable when the second tray 50 is in the first position. The discharge tray 60, which vertically sandwich the front end portion of the second tray 50, is not pivotable, either. Accordingly, the second sheets 24B, which are to be loaded into the second tray 50, are prevented from being loaded into the main tray 40 by mistake. The support portions 41D are each an example of a restraining portion. It is not necessary that the second tray 50 be entirely stored in the discharge tray 60 when the second tray 50 is in the second position as long as the second tray 50 is stored in such a manner that pivoting of the discharge tray 60 is not impeded. With this structure, the second tray 50 is pivotable integrally with the discharge tray 60 when the second tray 50 is in the second position. In addition, the discharge tray 60 is disposed at a position higher than the second tray 50.

In the embodiment depicted in FIGS. 1-9, the second tray 50 and the discharge tray 60 are coupled to each other by the guiderails 62. In another embodiment of the invention, a second tray 50 and a discharge tray 60 are coupled to each other by a coupling member which comprises an operation lever 81 coupled to the second tray 50 and guiderails 91.

Figure 12A:
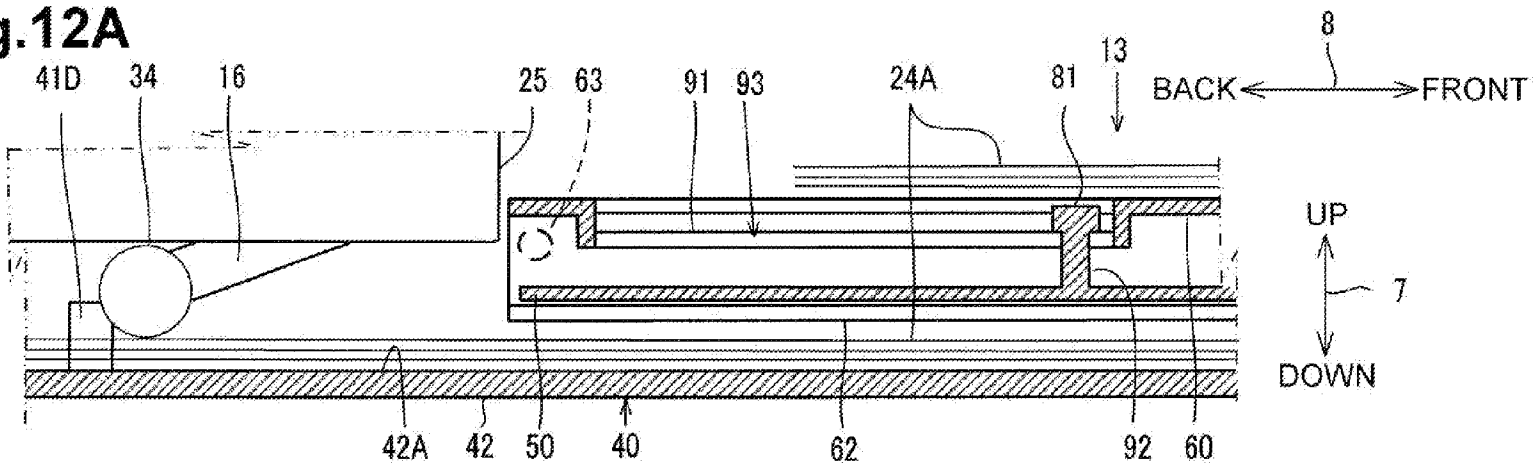
FIGS. 12A and 12B are schematic cross-sectional views of a tray unit according to another embodiment of the invention.
Figure 12B:
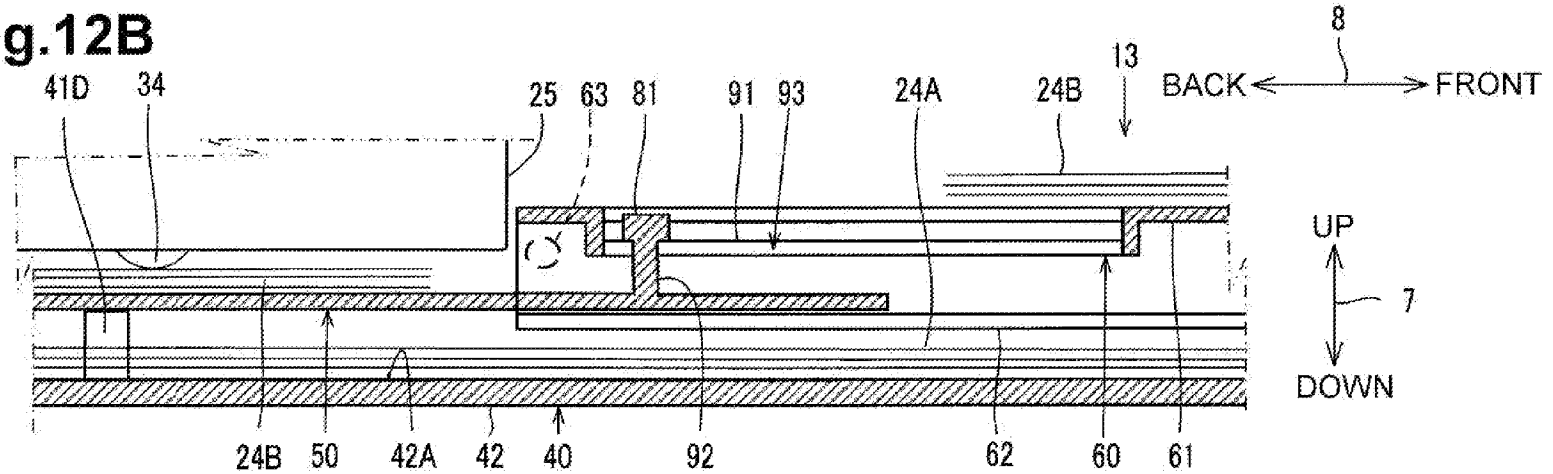

In this embodiment, as shown in FIGS. 12A and 12B, the discharge tray 60 comprises the guiderails 91 that are in contact with the left and right end portions of the bottom surface of the operation lever 81. The discharge tray 60 has a through hole 93 through which a connecting portion 92, which connects the operation lever 81 to the second tray 50, extends such that the operation lever 81 hangs from the guiderails 91. The second tray 50 and the discharge tray 60 are coupled to each other by the operation lever 81 and the guiderails 91. As shown in FIG. 12B, a back portion of the second tray 50 is supported by support portions 41D provided on side walls of a main tray 40 when the second tray 50 is in the first position. With this structure, the second tray 50 is pivotable integrally with the discharge tray 60 when the second tray 50 is in the second position. In addition, the discharge tray 60 is disposed at a position higher than the second tray 50.

In place of the coupling members in the embodiment depicted in FIGS. 1-9 and the embodiment depicted in FIGS. 12A and 12B, another coupling member may be used as long as the second tray 50 and the discharge tray 60 are coupled to each other without impeding the sliding movement of the second tray 50. In addition, although the above-described embodiments, the coupling members extend in the front-back direction 8, a coupling member may be divided in the front-back direction 8 as long as the coupling member is configured to couple the second tray 50 and the discharge tray 60 to each other when the second tray 50 is in the first position and the second position.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image recording device comprising:

a housing;

a tray unit mounted in the housing and configured to hold thereon a first sheet and a second sheet;

a feeder disposed above the tray unit and configured to selectively feed the first sheet and the second sheet from the tray unit in a first direction;

a recording unit disposed above the feeder and configured to record an image on the sheet fed by the feeder; and a discharging unit configured to discharge the sheet after the recording unit records the image on the sheet, wherein the tray unit comprises:

a first tray comprising a first holding surface for holding thereon the first sheet;

a second tray comprising a second holding surface for holding thereon the second sheet and configured to move above the first holding surface between a first position and a second position which is upstream in the first direction from the first position, wherein the second tray further comprises a pivoting portion configured to pivot relative to the first tray; and a third tray supported by the first tray and disposed above the second tray in the second position, and configured to receive the sheet discharged by the discharging unit.

2. The image recording device according to claim 1, wherein the third tray is supported by the first tray such that the third tray pivots between a lying position in which the third tray extends along the first holding surface and a standing position in which the third tray stands upward with respect to the first holding surface.

3. The image recording device according to claim 2, wherein the second tray in the second position is below the third tray in the lying position, and wherein at least one of the second tray and the third tray comprises a coupling member configured to couple the third tray and the second tray in the second position to each other when the third tray pivots from the lying position to the standing position.

4. The image recording device according to claim 3, wherein the coupling member is configured to couple the third tray and the second tray in the first position to each other such that the third tray is restrained from pivoting from the lying position to the standing position.

5. The image recording device according to claim 2, wherein a pivot axis of the pivoting portion of the second tray substantially coincides, in position, with a pivot axis of the third tray when the second tray is in the second position, and the pivot axis of the pivoting portion of the second tray is deviated from the pivot axis of the third tray when the second tray is in the first position.

6. The image recording device according to claim 1, wherein the second tray comprises a sliding portion configured to slide relative to the first tray and to pivotably support the pivoting portion, and wherein the first tray comprises a rail configured to support the sliding portion of the second tray such that the second tray slides between the first position and the second position.

7. The image recording device according to claim 3, wherein the coupling member comprises two surfaces formed in the third tray and extending in a direction crossing a pivoting direction of the second tray, and the two surfaces sandwich the second tray.

8. The image recording device according to claim 3, wherein the coupling member comprises a storing portion formed in the third tray and configured to store therein the second tray in the second position and to sandwich a part of the second tray in the first position, and wherein the first tray comprises a restraining portion configured to contact the second tray in the first position and to restrain the second tray from pivoting.

9. The image recording device according to claim 1, wherein the third tray comprises an auxiliary tray configured to move between a stored position in which the auxiliary tray is stored in the third tray and a projecting position in which the auxiliary tray is projecting in a direction opposite to the first direction and receives the sheet discharged by the discharging unit.

10. An image recording device comprising:

a housing;

a tray unit mounted in the housing and configured to hold thereon a first sheet and a second sheet;

a feeder disposed above the tray unit and configured to selectively feed the first sheet and the second sheet from the tray unit in a first direction;

a recording unit disposed above the feeder and configured to record an image on the sheet fed by the feeder; and a discharging unit configured to discharge the sheet after the recording unit records the image on the sheet, wherein the tray unit comprises:

a first tray comprising a first holding surface for holding thereon the first sheet a second tray comprising a second holding surface for holding thereon the second sheet and configured to move above the first holding surface between a first position and a second position which is upstream in the first direction from the first position; and a third tray supported by the first tray and disposed above the second tray in the second position, and configured to receive the sheet discharged by the discharging unit, and wherein the second tray comprises a support portion projecting beyond the third tray in a direction opposite to the first direction when the second tray is in the second position, and the support portion is configured to support the first sheet discharged by the discharging unit in cooperation with the third tray.

11. The image recording device according to claim 10, wherein the second tray comprises an auxiliary tray configured to move between a stored position in which the auxiliary tray is stored in the second tray and a projecting position in which the auxiliary tray is projecting in the direction opposite to the first direction and receives the first sheet discharged by the discharging unit in corporation with the third tray and the support portion.

12. The image recording device according to claim 1, wherein the second tray comprises an operation member configured to be operated to move the second tray between the first position and the second position, and wherein the third tray has a first opening through which the operation member is exposed upward.

13. The image recording device according to claim 12, wherein the third tray comprises a mark with which the operation member is aligned when the second tray is in either one of the first position and the second position.

14. The image recording device according to claim 12, wherein the operation member is positioned below an upper surface of the third tray.

15. The image recording device according to claim 1, wherein the second tray comprises a positioning member configured to position an upstream edge of the second sheet in the first direction, and wherein the third tray has a second opening through which the positioning member is exposed upward when the second tray is in the first position.

16. The image recording device according to claim 1, wherein the tray unit is configured to be removed from the housing.

17. The image recording device according to claim 1, wherein the third tray is directly supported by the first tray.

18. The image recording device according to claim 1, wherein the third tray is configured to pivot about a pivot axis, which is perpendicular to the first direction, relative to the first tray between a lying position and a standing position, and wherein the second tray in the first position protrudes downstream in the first direction from the pivot axis about which the third tray is configured to pivot.

19. An image recording device comprising:

a housing;

a tray unit mounted in the housing and configured to hold thereon a first sheet and a second sheet;

a feeder disposed above the tray unit and configured to selectively feed the first sheet and the second sheet from the tray unit in a first direction;

a recording unit disposed above the feeder and configured to record an image on the sheet fed by the feeder; and a discharging unit configured to discharge the sheet after the recording unit records the image on the sheet, wherein the tray unit comprises:

a first tray comprising a first holding surface configured to hold thereon the first sheet;

a second tray comprising a second holding surface configured to hold thereon the second sheet and configured to move above the first holding surface between a first position and a second position which is upstream in the first direction from the first position, wherein the second tray further comprises a pivoting portion configured to pivot relative to the first tray; and a third tray disposed above the second tray in the second position and configured to receive the sheet discharged by the discharging unit and to pivot about a pivot axis, which is perpendicular to the first direction, relative to the first tray between a lying position and a standing position, and wherein, when the second tray is in the first position, the second tray protrudes downstream in the first direction from the pivot axis about which the third tray is configured to pivot, such that the third tray is restrained from pivoting from the lying position to the standing position.

* * * * *